US009723411B2

(12) United States Patent
Chiou et al.

(10) Patent No.: US 9,723,411 B2
(45) Date of Patent: Aug. 1, 2017

(54) PIEZOELECTRIC SPEAKER DRIVING SYSTEM AND METHOD THEREOF

(71) Applicant: NATIONAL CHIAO TUNG UNIVERSITY, Hsinchu (TW)

(72) Inventors: Jin-Chern Chiou, Hsinchu (TW); Tzu-Sen Yang, Taichung (TW); Yuan-Chen Liu, Taipei (TW)

(73) Assignee: NATIONAL CHIAO TUNG UNIVERSITY, Hsinchu (TW)

( * ) Notice: Subject to any disclaimer, the term of this patent is extended or adjusted under 35 U.S.C. 154(b) by 132 days.

(21) Appl. No.: 14/530,696

(22) Filed: Nov. 1, 2014

(65) Prior Publication Data

US 2016/0057545 A1 Feb. 25, 2016

(30) Foreign Application Priority Data

Aug. 21, 2014 (TW) ..... 103128830 A

(51) Int. Cl.
*H04R 17/00* (2006.01)
*H04R 3/00* (2006.01)
*G10K 9/122* (2006.01)

(52) U.S. Cl.
CPC ..... *H04R 17/00* (2013.01); *H04R 3/00* (2013.01); *G10K 9/122* (2013.01); *H04R 3/002* (2013.01)

(58) Field of Classification Search
CPC ..... H04R 17/00; H04R 3/002; H01L 41/00; H01L 41/02; G10K 9/122; G10K 2210/32291; B06B 2201/55
USPC ..... 381/190
See application file for complete search history.

(56) References Cited

U.S. PATENT DOCUMENTS 5,737,436 A * 4/1998 Boyden ..... G02C 11/06 381/327
6,411,015 B1 * 6/2002 Toda ..... H04R 17/00 310/330
6,612,399 B1 * 9/2003 Corsaro ..... G10K 9/122 181/171

(Continued)

FOREIGN PATENT DOCUMENTS

TW I235618 7/2005

OTHER PUBLICATIONS

T. Horikawa et al., "Application of Ceramic Piezoelectric Device to Audio Speaker," SICE Annual Conference 2008, Aug. 20-22, 2008, pp. 1-4.

(Continued)

*Primary Examiner* — Davetta W Goins
*Assistant Examiner* — Oyesola C Ojo
(74) *Attorney, Agent, or Firm* — CKC & Partners Co., Ltd.

(57) ABSTRACT

A piezoelectric speaker driving system includes a band splitter, a plurality of gain producers, an adder, a piezoelectric speaker, a sound compensator and a gain-adjusting device. The band splitter receives a first audio signal and splits the first audio signal into band signals. The gain producers gain the band signals respectively. The adder receives the gained band signals to generate a second audio signal. The piezoelectric speaker outputs a sound according to the second audio signal. The sound compensator analyzes a sound pressure level of the sound to generate a control signal. The gain-adjusting device adjusts the gains of the gain producers according to the control signal.

8 Claims, 4 Drawing Sheets

(56) References Cited

U.S. PATENT DOCUMENTS

| | | | | |
|---|---|---|---|---|
| 7,082,205 | B1 * | 7/2006 | Westermann | H04R 25/305 381/312 |
| 2003/0053647 | A1 * | 3/2003 | Kates | H04R 3/002 381/318 |
| 2005/0015252 | A1 | 1/2005 | Marumoto | |
| 2007/0217625 | A1 | 9/2007 | Bai et al. | |
| 2009/0196442 | A1 | 8/2009 | Eaton | |
| 2010/0246869 | A1 * | 9/2010 | Zhang | H04R 25/70 381/320 |
| 2010/0316226 | A1 * | 12/2010 | Yoneda | H04R 3/002 381/59 |
| 2011/0002486 | A1 | 1/2011 | Ishizaki | |
| 2011/0249823 | A1 * | 10/2011 | Thomsen | H04R 25/552 381/23.1 |
| 2013/0061438 | A1 | 3/2013 | Kim et al. | |
| 2013/0148826 | A1 * | 6/2013 | Chung | H03G 3/20 381/107 |
| 2013/0156225 | A1 | 6/2013 | Winegar | |
| 2013/0259241 | A1 * | 10/2013 | Schul | H04R 3/002 381/56 |
| 2014/0135078 | A1 | 5/2014 | Nigam et al. | |
| 2015/0181338 | A1 * | 6/2015 | Hosoi | H04R 5/033 381/309 |

OTHER PUBLICATIONS

Leung Kin Chiu et al., "Audio Output Enhancement Algorithms for Piezoelectric Loudspeakers," Proceedings of IEEE Digital Signal Processing Workshop, 2011, pp. 317-320.

Hye Jin Kim et al., "Improvement of Low-Frequency Characteristics of Piezoelectric Speakers Based on Acoustic Diaphragms," IEEE Transactions on Ultrasonics, Ferroelectrics, and Frequency Control, vol. 59, No. 9, Sep. 2012, pp. 2027-2035.

Jun Kuroda et al., "The driving system for piezoelectric speaker with low power consumption," The Acoustical Society of Japan, Acoust. Sci. & Tech. 33, 6 (2012), pp. 372-375.

* cited by examiner

PIEZOELECTRIC SPEAKER DRIVING SYSTEM AND METHOD THEREOF

RELATED APPLICATIONS

This application claims priority to Taiwanese Application Serial Number 103128830, filed Aug. 21, 2014, the entirety of which is herein incorporated by reference.

BACKGROUND

Field of Invention

The invention relates to a piezoelectric speaker driving system, and particularly relates to a piezoelectric speaker driving system and method that may improve the sound pressure level of a sound form a piezoelectric speaker.

Description of Related Art

The principle of operation of a piezoelectric speaker is very different from that of the traditional coil driven speaker. According to the traditional coil driven speaker technology, the coil is provided in an external magnetic field and is attached to a diaphragm. When an electric current is passed through the coil, a magnetic field is created around it and under interaction with the external magnetic field reacts, so as to generate a mechanical vibration to the diaphragm and excite acoustic airwave. In other words, the electric energy is first converted to the magnetic energy, and then is converted to the mechanical force on the diaphragm to generate sound. On the other hand, in the piezoelectric speaker a piezoelectric material is attached to a diaphragm. When a voltage is applied across the piezoelectric material, its flexure or dimensional movement is transferred to the diaphragm to excite acoustic airwave. That is, the electric energy is directly converted to the mechanical force on the diaphragm to generate sound, such that the piezoelectric speaker has improved energy conversion efficiency compared with the traditional coil driven speaker. Therefore, the piezoelectric speaker is widely used in the portable devices. However, the piezoelectric material has a relatively poor frequency response of sound pressure level, particularly at the lower frequency band, in view of the coil driven speaker.

Typically, different ways of making and attaching a structure between the piezoelectric material and the diaphragm are used to address the above issues of the piezoelectric speaker. However, the structure is easily subjected to the influence of the whole structure of the piezoelectric speaker. Therefore, there is a need for a user to improve the sound pressure level of the piezoelectric material at the lower frequency band.

SUMMARY

Accordingly, the present invention provides a piezoelectric speaker driving system and method that may improve the sound pressure level of a sound from a piezoelectric speaker.

The invention provides a piezoelectric speaker driving system. The system comprises a band splitter, a plurality of gain producers, an adder, a piezoelectric speaker, a sound compensator and a gain-adjusting device. The band splitter receives a first audio signal and splits the first audio signal into a plurality of band signals. The gain producers gain the band signals respectively. The adder receives the gained band signals to generate a second audio signal. The piezoelectric speaker outputs a sound according to the second audio signal. The sound compensator analyzes a sound pressure level of the sound to generate a control signal. The gain-adjusting device is coupled with the sound compensator and is configured to adjust the gains of the gain producers according to the control signal.

In an embodiment, the piezoelectric speaker driving system further comprises a filter coupling with the adder to filter the second audio signal.

In an embodiment, the piezoelectric speaker driving system further comprises an amplifier coupling with the filter to amplify the filtered second audio signal.

In an embodiment, the sound compensator further comprises a sound receiving device and an analyzer. The sound receiving device receives the sound from the piezoelectric speaker. The analyzer couples with the sound receiving device and configured to analyze the sound pressure level of the sound to generate a control signal. The analyzer compares the sound pressure level with a standard sound pressure level to generate the control signal.

In an embodiment, the sound receiving device is a microphone.

In an embodiment, analog filters are arranged in parallel connection to form the band splitter and the gain producers, wherein analog filters correspond to band signals respectively.

In an embodiment, a digital filter realizes the band splitter and the gain producers.

The invention provides a piezoelectric speaker driving method. First, a first audio signal is split into a plurality of band signals having different bands. Then, the band signals are gained according a gain. The gained band signals are combined together to form a second audio signal. Next, a piezoelectric speaker outputs the sound according to the second audio signal and a control signal is generated according to the sound pressure level of the sound. The gains are adjusted according to the control signal. The adjusted gains are used to gain the band signals again. Then, the gained band signals are combined to form an amended second audio signal. The piezoelectric speaker outputs another sound according to the amended second audio signal.

Accordingly, a sound compensator is disposed in the piezoelectric speaker driving system to receive the sound from the piezoelectric speaker. The sound compensator generates a control signal according to the sound pressure level of the sound to adjust the gains of the gain producers to amend the audio signal again. Then, the piezoelectric speaker may generate a sound according to the amended audio signal. Since the amended audio signal has a compensated sound pressure level, the outputted sound according to the amended audio signal will also have a smooth sound pressure level. Since the audio signal is amended according the finally outputted sound, it is not necessary to change any device in the piezoelectric speaker driving system.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
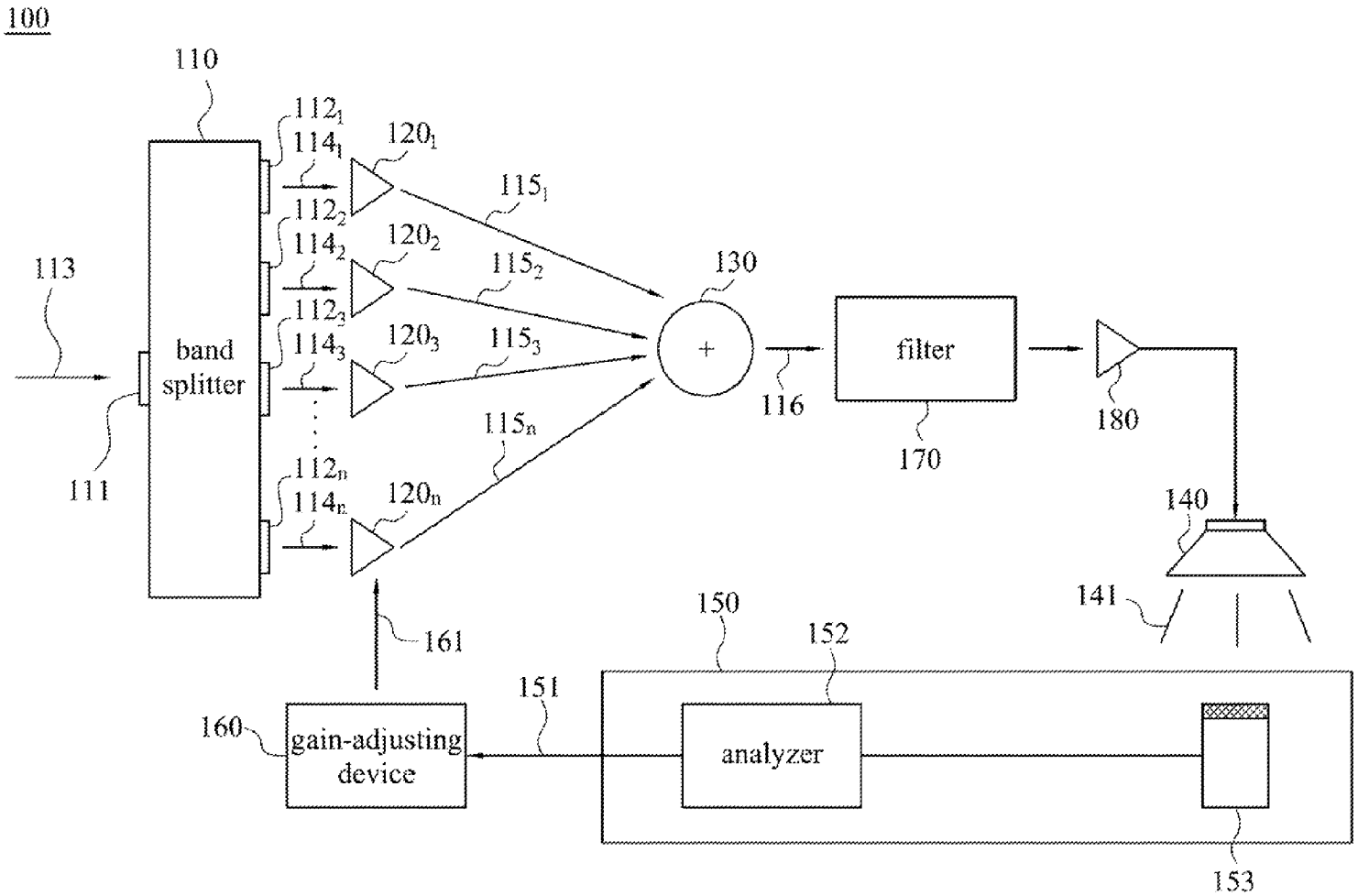
FIG. 1 illustrates a schematic diagram of a piezoelectric speaker driving system according to an embodiment of the invention.

Reference will now be made in detail to the present embodiments of the invention, examples of which are illustrated in the accompanying drawings. Wherever possible, the same reference numbers are used in the drawings and the description to refer to the same or like parts. It is noted that, in accordance with the standard practice in the industry, various features are not drawn to scale. In fact, the dimensions of the various features may be arbitrarily increased or reduced for clarity of discussion.

FIG. 1 illustrates a schematic diagram of a piezoelectric speaker driving system according to an embodiment of the invention. The piezoelectric speaker driving system 100 comprises a band splitter 110, a plurality of gain producers $\mathbf{120}_1$, $\mathbf{120}_2$, . . . , $\mathbf{120}_n$, an adder 130, a piezoelectric speaker 140, a sound compensator 150 and a gain-adjusting device 160. The band splitter 110 has an input end 111 and a plurality of output ends $\mathbf{112}_1$, $\mathbf{112}_2$, . . . , $\mathbf{112}_n$. The input end 111 of the band splitter 110 receives a first audio signal 113. The first audio signal 113 is split into a plurality of band signals $\mathbf{114}_1$, $\mathbf{114}_2$, . . . , $\mathbf{114}_n$ by the band splitter 110. Then, the band signals $\mathbf{114}_1$, $\mathbf{114}_2$, . . . , $\mathbf{114}_n$ are outputted from the output ends $\mathbf{112}_1$, $\mathbf{112}_2$, . . . , $\mathbf{112}_n$ respectively. These band signals $\mathbf{114}_1$, $\mathbf{114}_2$, . . . , $\mathbf{114}_n$, have different bands. In an embodiment, the band splitter 110 splits the first audio signal 113 into band signals $\mathbf{114}_1$, $\mathbf{114}_2$, . . . , $\mathbf{114}_n$ according to a band width of 100 Hz. However, in another embodiment, other band widths also can be used to split the first audio signal 113. The gain producers $\mathbf{120}_1$, $\mathbf{120}_2$, . . . , $\mathbf{120}_n$ couple with the output ends $\mathbf{112}_1$, $\mathbf{112}_2$, . . . , $\mathbf{112}_n$ respectively to receive the band signals $\mathbf{114}_1$, $\mathbf{114}_2$, . . . , $\mathbf{114}_n$ to gain their the amplitude of vibration. In an embodiment, each gain producers $\mathbf{120}_1$, $\mathbf{120}_2$, . . . , $\mathbf{120}_n$ has an adjustable gain. An adjusting signal 161 is used to adjust the gains of the gain producers $\mathbf{120}_1$, $\mathbf{120}_2$, . . . , $\mathbf{120}_n$ to amend the amplitude of vibration to smooth the sound pressure level. The adder 130 couples with the gain producers $\mathbf{120}_1$, $\mathbf{120}_2$, . . . , $\mathbf{120}_n$ to receive the gained band signals $\mathbf{115}_1$, $\mathbf{115}_2$, . . . , $\mathbf{115}_n$ to generate a second audio signal 116. The second audio signal 116 is outputted to the piezoelectric speaker 140. The piezoelectric speaker 140 outputs a sound 141 according to the second audio signal 116. The piezoelectric speaker 140 is a piezoelectric ceramics speaker.

Figure 2:
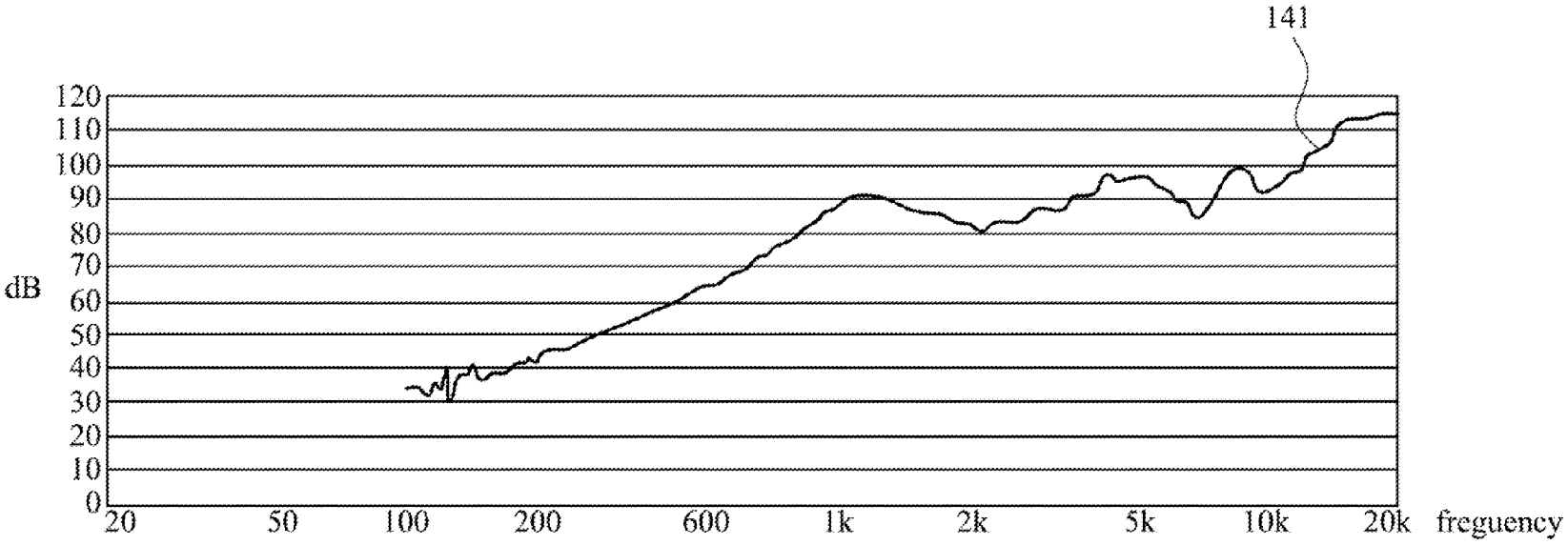
FIG. 2 illustrates a curve of the frequency and the sound pressure level of a sound outputted from a piezoelectric speaker.

For an ideal speaker, when the ideal speaker receives an audio signal having same amplitude of vibration, the ideal speaker should output a sound having same sound pressure level in different frequency. However, since the natural structure of the piezoelectric speaker, it is very difficult for the piezoelectric speaker to reach the above requirement. FIG. 2 illustrates a curve of the frequency and the sound pressure level of a sound outputted from a piezoelectric speaker. The sound pressure level is varied according to the frequency. The sound pressure level is very low in the low frequency band and the sound pressure level is varied in the middle frequency band, which results in the volume being changed in different frequency bands. The sound is distorted. Therefore, a sound compensator 150 is used in the claimed invention to amend the output sound 141. The sound compensator 150 couples with the gain-adjusting device 160. The sound compensator 150 receives the sound 141 outputted from the piezoelectric speaker 140 to analyze the sound pressure level of the sound 141 to generate a control signal 151. The control signal 151 controls the gain-adjusting device 160. The gain-adjusting device 160 generates an adjusting signal 161 according to the control signal 151 to adjust the gains of the gain producers $\mathbf{120}_1$, $\mathbf{120}_2$, . . . , $\mathbf{120}_n$. In an embodiment, according to the FIG. 2, when a 9 volt voltage is applied to the piezoelectric speaker, the sound pressure level of the sound 141 is 90 dB in the frequency of 1 k, the sound pressure level of the sound 141 is 80 dB in the frequency of 2 k, the sound pressure level of the sound 141 is 90 dB in the frequency of 3.5 k, the sound pressure level of the sound 141 is 82 dB in the frequency of 7 k and the sound pressure level of the sound 141 is 115 dB in the frequency of 20 k. The sound pressure level of the sound 141 is varied according to the frequency. Accordingly, if the sound pressure level of 90 dB is served as a standard sound pressure level to smooth the sound pressure level curve of the sound 141, the gains of the gain producers $\mathbf{120}_1$, $\mathbf{120}_2$, . . . , $\mathbf{120}_n$ corresponding to the first audio signal 113 having the frequency of 2 k and 7 k are increased to raise the amplitude of vibration of the first audio signal 113 having the frequency of 2 k and 7 k so that the sound pressure level of the sound 141 is increased in the frequency of 2 k and 7 k. Similarly, the gain of the gain producers $\mathbf{120}_1$, $\mathbf{120}_2$, . . . , $\mathbf{120}_n$ corresponding to the first audio signal 113 having the frequency of 20 k is decreased to draw down the amplitude of vibration of the first audio signal 113 having the frequency of 20 k so that the sound pressure level of the sound 141 is decreased in the frequency of 20 k. The rest may be deduced by analogy. Then, all the amended first audio signals 113, the gained band signals $\mathbf{115}_1$, $\mathbf{115}_2$, . . . , $\mathbf{115}_n$, are combined together by the adder 130 to output an amended second audio signal 116. Therefore, the piezoelectric speaker 140 can output a sound 141 that has a smooth sound pressure level of 90 dB according to the amended second audio signal 116. Accordingly, a sound compensator 150 is disposed in the piezoelectric speaker driving system 100 to amend the sound pressure level of the output sound 141 from the piezoelectric speaker 140. Therefore, it is not necessary to change any device in the piezoelectric speaker driving system 100.

In an embodiment, the sound compensator 150 further comprises an analyzer 152 and a sound receiving device 153. The sound receiving device 153 receives the sound 141 outputted from the piezoelectric speaker 140. The analyzer 152 couples with the sound receiving device 153 to analyze the sound pressure level of the sound 141 to generate a control signal 151. The sound receiving device 153 is a microphone. The sound receiving device 153 is located at a position apart from the piezoelectric speaker 140 about 10 cm to receive the sound 141 and transmits the sound 141 to the analyzer 152. The analyzer 152 analyzes the sound pressure level of the sound 141 to generate the control signal 151. In an embodiment, the analyzer 152 generates the control signal 151 according to a standard sound pressure level. That is, the analyzer 152 compares the sound pressure level of the sound 141 with the standard sound pressure level to generate the control signal 151. In another embodiment, the piezoelectric speaker driving system 100 further comprises a filter 170 coupling with the adder 130 and an amplifier 180 coupling with the filter 170. The filter 170 filters the second audio signal 116. The amplifier 180 amplifies the filtered second audio signal 116 to transmit to the piezoelectric speaker 140. The piezoelectric speaker 140 outputs the sound 141 according to the amplified second audio signal 116.

Figure 3:
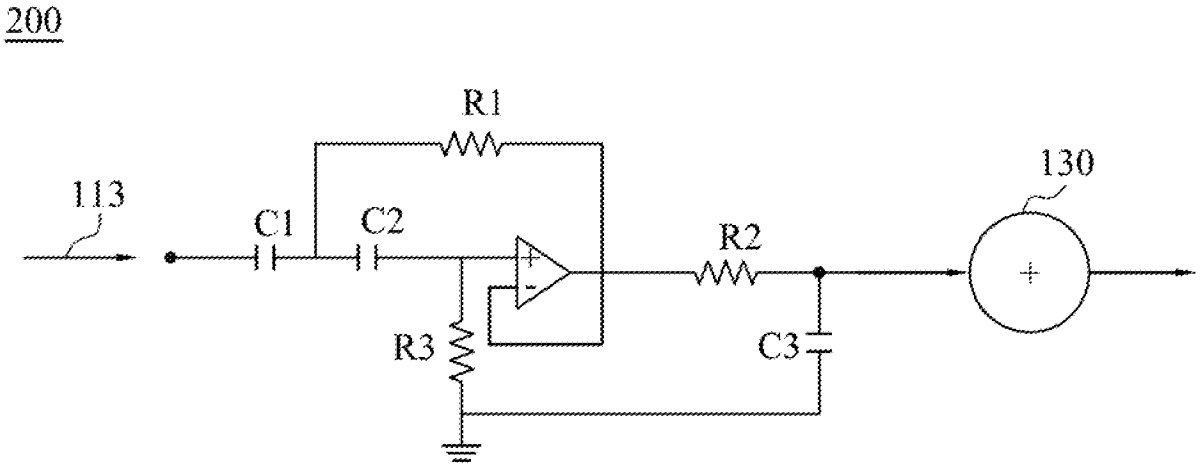
FIG. 3 illustrates a schematic diagram of an analog high-pass filter according to an embodiment of the invention.

In an embodiment, analog circuits are used to realize the band splitter 110 and the gain producers $\mathbf{120}_1$, $\mathbf{120}_2$, . . . , $\mathbf{120}_n$. FIG. 3 illustrates a schematic diagram of an analog high-pass filter according to an embodiment of the invention. In the high-pass filter 200, the capacitance of the capacitor C1, C2 and C3 can be changed to split the first audio signal 113 into the band signals $\mathbf{114}_1$, $\mathbf{114}_2$, . . . , $\mathbf{114}_n$. Moreover, the resistance of the resistor R1 and R2 can be also changed to change the gain. Accordingly, an analog high-pass filter generates a specific band signal and a gain. In this claimed invention, a plurality of analog high-pass filters are arranged in parallel connection to form the band splitter 110 and the gain producers $\mathbf{120}_1$, $\mathbf{120}_2$, . . . , $\mathbf{120}_n$. It is noticed that, in other embodiments, an analog low-pass filter or an analog band-pass filter or an combination of the low-pass filter, the band-pass filter and the high-pass can be used to realize the band splitter 110 and the gain producers $\mathbf{120}_1$, $\mathbf{120}_2$, . . . , $\mathbf{120}_n$. In another embodiment, a digital filter can be also used to realize the band splitter 110 and the gain producers $\mathbf{120}_1$, $\mathbf{120}_2$, . . . , $\mathbf{120}_n$. In this embodiment, the gain-adjusting device is a register that stores the parameter of the standard sound pressure level. The gains of the gain producers $\mathbf{120}_1$, $\mathbf{120}_2$, . . . , $\mathbf{120}_n$ are adjusted by reading the parameter of the standard sound pressure level in the register.

Figure 4:
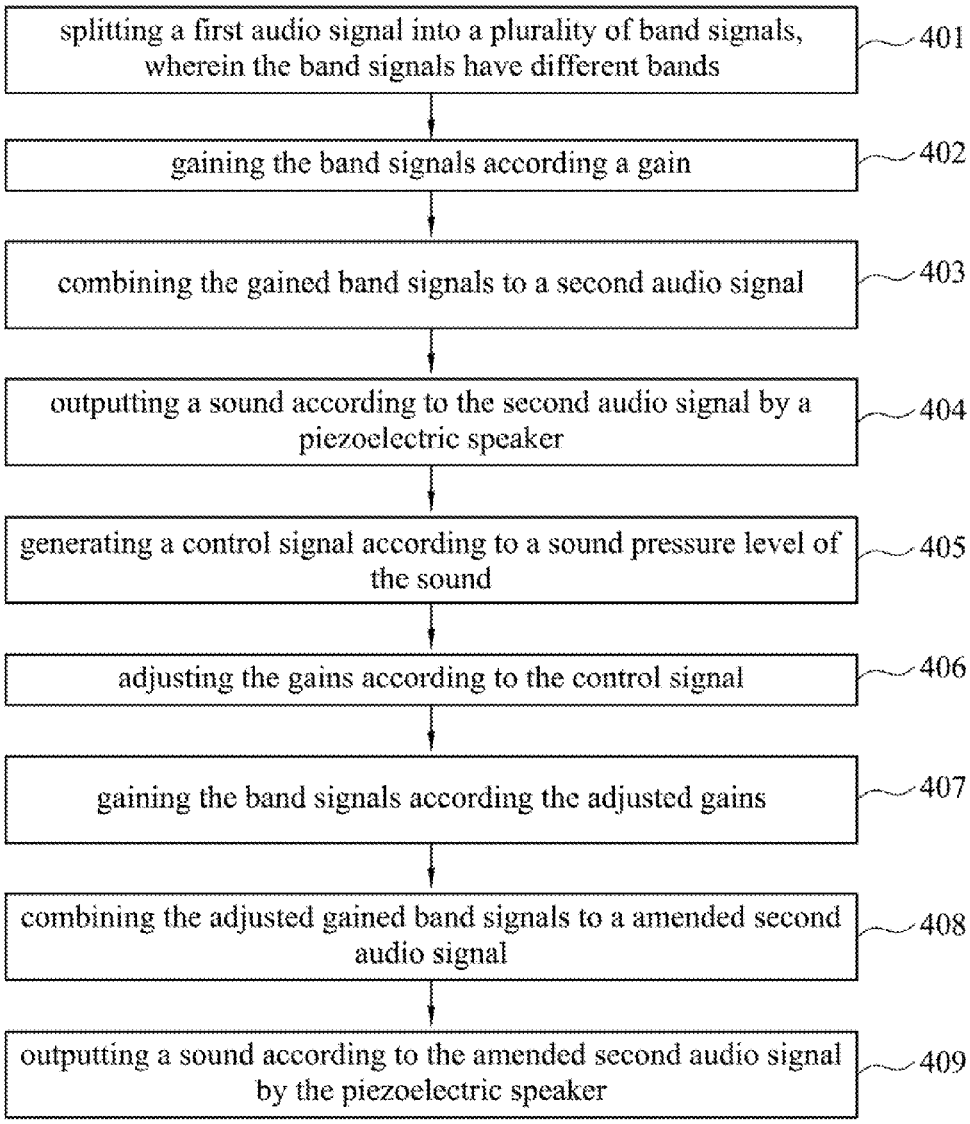
FIG. 4 illustrates a flow chart of a piezoelectric speaker driving method according to an embodiment of the invention.

FIG. 4 illustrates a flow chart of a piezoelectric speaker driving method according to an embodiment of the invention. Please refer to FIG. 1 and FIG. 4. In step 401, a first audio signal is split into a plurality of band signals having different bands. In an embodiment, the band splitter 110 receives a first audio signal 113. The first audio signal 113 is split into a plurality of band signals $\mathbf{114}_1$, $\mathbf{114}_2$, . . . , $\mathbf{114}_n$ by the band splitter 110. These band signals $\mathbf{114}_1$, $\mathbf{114}_2$, . . . , $\mathbf{114}_n$ have different bands.

Next, in step 402, the band signals are gained according to a gain. In an embodiment, a plurality of gain producers $\mathbf{120}_1$, $\mathbf{120}_2$, . . . , $\mathbf{120}_n$ couple with the output ends $\mathbf{112}_1$, $\mathbf{112}_2$, . . . , $\mathbf{112}_n$ of the band splitter 110 respectively to receive the band signals $\mathbf{114}_1$, $\mathbf{114}_2$, . . . , $\mathbf{114}_n$ to gain their the amplitude of vibration to generate the band signals $\mathbf{115}_1$, $\mathbf{115}_2$, . . . , $\mathbf{115}_n$.

Then, in step 403, the gained band signals are combined together to generate a second audio signal. In step 404, a piezoelectric speaker outputs a sound 141 according to the second audio signal. In an embodiment, an adder 130 couples with the gain producers $\mathbf{120}_1$, $\mathbf{120}_2$, . . . , $\mathbf{120}_n$ to receive the gained band signals $\mathbf{115}_1$, $\mathbf{115}_2$, . . . , $\mathbf{115}_n$ to generate a second audio signal 116. The second audio signal 116 is transmitted to the piezoelectric speaker 140. The piezoelectric speaker 140 output a sound 141 according to the second audio signal 116.

Then, in step 405, a control signal is generated according to the sound pressure level of the sound. In step 406, the gains are adjusted according to the control signal. In an embodiment, a sound compensator 150 couples with the gain-adjusting device 160. The sound compensator 150 receives the sound 141 outputted from the piezoelectric speaker 140 to analyze the sound pressure level of the sound 141 to generate a control signal 151. The control signal 151 controls the gain-adjusting device 160. The gain-adjusting device 160 generates an adjusting signal 161 according to the control signal 151 to adjust the gains of the gain producers $\mathbf{120}_1$, $\mathbf{120}_2$, . . . , $\mathbf{120}_n$.

Next, in step 407, the band signals are gained according to the adjusted gains. In step 408, the gained band signals are combined to form an amended second audio signal. Then, in step 409, the piezoelectric speaker outputs a sound according to the amended second audio signal. In an embodiment, the adjusted gains are used to gain the band signals $\mathbf{114}_1$, $\mathbf{114}_2$, . . . , $\mathbf{114}_n$ of the first audio signal again. Then, the gained band signals $\mathbf{115}_1$, $\mathbf{115}_2$, . . . , $\mathbf{115}_n$, are combined together by the adder 130 to output an amended second audio signal 116. The piezoelectric speaker 140 outputs a sound 141 according to the amended second audio signal 116. Since the amended second audio signal 116 has an amended sound pressure level, the sound 141 will have a smooth sound pressure level.

Accordingly, a sound compensator is disposed in the piezoelectric speaker driving system to receive the sound from the piezoelectric speaker. The sound compensator generates a control signal according to the sound pressure level of the sound to adjust the gains of the gain producers to amend the audio signal again. Then, the piezoelectric speaker may generate a sound according to the amended audio signal. Since the amended audio signal has a compensated sound pressure level, the outputted sound according to the amended audio signal will also have a smooth sound pressure level. Since the audio signal is amended according the finally outputted sound, it is not necessary to change any device in the piezoelectric speaker driving system.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A piezoelectric speaker driving system, comprising:

a band splitter having a plurality of output ends, the band splitter receiving a first audio signal and splitting the first audio signal into a plurality of band signals, wherein the band signals have different bands and are outputted from the output ends;

a plurality of gain producers coupling with the output ends to generate a plurality of gains respectively to gain the band signals;

an adder coupling with the gain producers, wherein the gained band signals are added together by the adder to generate a second audio signal;

a piezoelectric speaker coupling with the adder to output a sound according to the second audio signal;

a sound compensator receiving the sound to analyze a sound pressure level of the sound to generate a control signal; and a gain-adjusting device coupling with the sound compensator, and configured to adjust the gains of the gain producers according to the control signal, wherein the sound compensator compares the sound pressure level with a required sound pressure level to generate the control signal, wherein the required sound pressure level identifies the band signals in which the sound pressure level of the sound generated by the piezoelectric speaker has loss, wherein when the sound pressure level of one of the band signals is lower than the required sound pressure level, the gain-adjusting device increases a corresponding gain to gain the one of the band signals to make the piezoelectric speaker output an adjusted sound with a sound pressure level reach the required sound pressure level, and when the sound pressure level of one of the band signals is higher than the required sound pressure level, the gain-adjusting device decreases a corresponding gain to gain the one of the band signals to make the piezoelectric speaker output an adjusted sound with a sound pressure level reaching the required sound pressure level.

2. The piezoelectric speaker driving system of claim 1, further comprising a filter coupling with the adder to filter the second audio signal.

3. The piezoelectric speaker driving system of claim 2, further comprising an amplifier coupling with the filter to amplify the filtered second audio signal.

4. The piezoelectric speaker driving system of claim 1, wherein the sound compensator further comprises:

a sound receiving device receiving the sound from the piezoelectric speaker; and an analyzer coupling with the sound receiving device and configured to compare the sound pressure level with the standard sound pressure level to generate the control signal.

5. The piezoelectric speaker driving system of claim 4, wherein the sound receiving device is a microphone.

6. The piezoelectric speaker driving system of claim 4, wherein the band splitter and the gain producers are formed with a plurality of analog filters arranged in parallel connection, wherein the analog filters correspond to band signals respectively.

7. The piezoelectric speaker driving system of claim 4, wherein the band splitter and the gain producers is realized by a digital filter.

8. A piezoelectric speaker driving method, comprising:

splitting a first audio signal into a plurality of band signals, wherein the band signals have different bands;

gaining the band signals according a plurality of gains respectively;

generating a second audio signal, wherein the gained band signals are added together to generate the second audio signal;

outputting a sound according to the second audio signal by a piezoelectric speaker;

generating a control signal, wherein a sound pressure level of the sound is compared with a required sound pressure level to generate the control signal, wherein the required sound pressure level identifies band signals in which the sound pressure level of the sound generated by the piezoelectric speaker has loss;

adjusting the gains according to the control signal;

gaining the band signals according the adjusted gains;

generating an amended second audio signal, wherein the adjusted gained band signals are added together to generate the amended second audio signal; and outputting a sound according to the amended second audio signal by the piezoelectric speaker, wherein when the sound pressure level of one of the band signals is lower than the required sound pressure level, a corresponding gain is increased to gain the one of the band signals to make the piezoelectric speaker output an adjusted sound with a sound pressure level reach the required sound pressure level, and when the sound pressure level of one of the band signals is higher than the required sound pressure level, a corresponding gain is decreased to gain the one of the band signals to make the piezoelectric speaker output an adjusted sound with a sound pressure level reaching the required sound pressure level.

* * * * *